US010649365B2

(12) United States Patent
Watanabe et al.

(10) Patent No.: US 10,649,365 B2
(45) Date of Patent: May 12, 2020

(54) DEVELOPING DEVICE AND IMAGE FORMING DEVICE

(71) Applicant: KONICA MINOLTA, INC., Chiyoda-ku, Tokyo (JP)

(72) Inventors: Wataru Watanabe, Hachioji (JP); Shota Sakurai, Machida (JP); Tomohiro Kawasaki, Sagamihara (JP); Takenobu Kimura, Hachioji (JP); Ryoei Ikari, Tokorozawa (JP)

(73) Assignee: Konica Minolta, Inc., Chiyoda-ku, Tokyo (JP)

( * ) Notice: Subject to any disclaimer, the term of this patent is extended or adjusted under 35 U.S.C. 154(b) by 0 days.

(21) Appl. No.: 16/158,391

(22) Filed: Oct. 12, 2018

(65) Prior Publication Data

US 2019/0129328 A1 May 2, 2019

(30) Foreign Application Priority Data

Oct. 30, 2017 (JP) ..... 2017-209059

(51) Int. Cl.

*G03G 15/08* (2006.01)
*G03G 15/00* (2006.01)
*G03G 15/16* (2006.01)

(52) U.S. Cl.

CPC ..... *G03G 15/0812* (2013.01); *G03G 15/0844* (2013.01); *G03G 15/0848* (2013.01); *G03G 15/1645* (2013.01); *G03G 15/5037* (2013.01); *G03G 15/5041* (2013.01); *G03G 15/5054* (2013.01); *G03G 15/0891* (2013.01);
(Continued)

(58) Field of Classification Search

CPC ..... G03G 15/0812; G03G 15/0844; G03G 15/0848; G03G 15/0891; G03G 15/1645; G03G 15/5004; G03G 15/5037; G03G 15/5041; G03G 15/5054; G03G 2215/00042

See application file for complete search history.

(56) References Cited

U.S. PATENT DOCUMENTS 4,519,695 A * 5/1985 Murai ..... G03G 15/00 118/691
5,212,522 A * 5/1993 Knapp ..... G03G 15/0806 399/24

(Continued)

FOREIGN PATENT DOCUMENTS

JP 2004226658 A 8/2004
JP 2006220988 A 8/2006
JP 2007156355 A 6/2007

*Primary Examiner* — David J Bolduc
(74) *Attorney, Agent, or Firm* — Buchanan Ingersoll & Rooney PC

(57) ABSTRACT

A developing device for forming an image by developing an electrostatic latent image formed on an image carrier with a developer, includes: a developing container that accommodates the developer; a developing roller that faces the image carrier, is disposed adjacent to the developing container, and conveys the developer accommodated in the developing container to the image carrier, and a developer discharging part that is provided in the developing container and discharges a part of the developer, wherein a discharge amount of the developer discharged by the developer discharging part is controlled on the basis of a charge amount of a toner included in the developer.

18 Claims, 11 Drawing Sheets

(52) U.S. Cl.
CPC ..... *G03G 15/5004* (2013.01); *G03G 2215/00042* (2013.01)

(56) References Cited

U.S. PATENT DOCUMENTS 5,237,371 A * 8/1993 Hori ..... G03G 15/0887 399/253
5,430,532 A * 7/1995 Ueda ..... G03G 15/08 399/263
5,440,376 A * 8/1995 Hagihara ..... G03G 15/0844 399/120
5,512,981 A * 4/1996 Hirsch ..... G03G 15/0844 399/257
5,834,634 A * 11/1998 Honda ..... G01N 27/60 73/53.01
5,983,044 A * 11/1999 Kodama ..... G03G 15/065 399/49
6,047,142 A * 4/2000 Donaldson ..... G03G 15/0848 399/27
7,177,557 B2 * 2/2007 Kreckel ..... G03G 15/0844 399/257
2004/0170441 A1 * 9/2004 Forbes, II ..... G03G 15/0844 399/27
2004/0170442 A1 * 9/2004 Forbes, II ..... G03G 15/0844 399/27
2005/0158061 A1 * 7/2005 Do ..... G03G 15/0806 399/44
2005/0276616 A1 * 12/2005 Sasaki ..... G03G 15/1645 399/1
2006/0165440 A1 * 7/2006 Adachi ..... G03G 15/0844 399/254
2006/0198663 A1 * 9/2006 Miyoshi ..... G03G 15/0808 399/279
2007/0098449 A1 * 5/2007 Kadota ..... G03G 15/0848 399/254
2008/0044190 A1 * 2/2008 Silence ..... G03G 15/0849 399/27
2008/0240759 A1 * 10/2008 Kouno ..... G03G 15/0844 399/55
2009/0003865 A1 * 1/2009 Endou ..... G03G 15/0844 399/66
2009/0129792 A1 * 5/2009 Izumi ..... G03G 15/0844 399/27
2009/0148193 A1 * 6/2009 Hatakeyama ..... G03G 15/0844 399/254
2009/0245879 A1 * 10/2009 Minami ..... G03G 15/0822 399/255
2009/0290886 A1 * 11/2009 Murauchi ..... G03G 15/0844 399/27
2009/0290887 A1 * 11/2009 Murauchi ..... G03G 15/0844 399/27
2010/0321047 A1 * 12/2010 Zollner ..... G03G 15/5037 324/699
2010/0329709 A1 * 12/2010 Ochi ..... G03G 15/1675 399/49
2011/0123206 A1 * 5/2011 LeStrange ..... G03G 15/5033 399/29
2011/0164888 A1 * 7/2011 Kubo ..... G03G 15/0266 399/27
2012/0051794 A1 * 3/2012 Hayashi ..... G03G 15/0891 399/254
2012/0063795 A1 * 3/2012 Funatani ..... G03G 15/0189 399/44
2012/0070194 A1 * 3/2012 Okuno ..... G03G 15/0844 399/254
2013/0195519 A1 * 8/2013 Ito ..... G03G 15/1675 399/314
2014/0056600 A1 * 2/2014 Yotsutsuji ..... G03G 13/08 399/12
2015/0132030 A1 * 5/2015 Orihara ..... G03G 15/065 399/285
2016/0085196 A1 * 3/2016 Shirafuji ..... G03G 15/5041 399/49
2016/0266533 A1 * 9/2016 Takaya ..... G03G 15/556

* cited by examiner

DEVELOPING DEVICE AND IMAGE FORMING DEVICE

The entire disclosure of Japanese patent Application No. 2017-209059, filed on Oct. 30, 2017, is incorporated herein by reference in its entirety.

BACKGROUND

Technological Field

The present disclosure relates to a developing device and an image forming device.

Description of the Related Art

Electrophotographic type image forming devices have become widespread recently. A developing device is provided in an electrophotographic type image forming device. Tim developing device visualizes an electrostatic latent image formed on a photosensitive body by supplying a developer to the photosensitive body to form a toner image. The toner image is transferred on a sheet directly or indirectly, and then, heated and pressurized, so that an image is formed on the sheet. As a developing method for forming a toner image on a photosensitive body, there are one-component developing method and two-component developing method. In the one-component developing method, only a toner is used as a main component of the developer. In the two-component developing method, a toner and a carrier are used as main components of the developer. Some developing devices of the two-component developing method employ a trickle developing method. In the trickle developing method, a new carrier is also supplied together with the toner to always keep good charging characteristics. Therefore, if development is repeated over a long period of time, even if a resin coating layer on a carrier surface is worn and peeled in the developer, or toner components adhere and condense on the carrier surface, and charging characteristics of the carrier decrease, by the trickle developing method, the toner consumed in the image formation is fed and the carrier in a developing container of the developing device is replaced little by little and the charge amount is stabilized.

As a developing device of such a trickle developing type, a device has been proposed in which, when a carrier is discharged to a photosensitive body, the amount of carrier to be discharged is detected, and the amount of carrier to be discharged is changed on the basis of a predicted value of the amount of developer to be supplied and the amount of carrier to be discharged (for example, see JP 2004-226658 A). In addition, there has also been proposed a device that increases or decreases the amount of discharged developer in accordance with an index corresponding to the degree of deterioration of the developer (for example, see JP 2006-220988 A). In addition, as a trickle developing method, there has also been proposed a device that discharges surplus developer by extrusion (for example, see JP 2007-156355 A).

However, in the prior art as disclosed in JP 2004-226658 A, as a result of controlling the amount of carriers to be discharged, the charge amount is changed. In the prior art as disclosed in JP 2006-220988 A, an index that largely correlates with a change in a bulk density of a developer is used as an index corresponding to the degree of deterioration of the developer. Since the prior art as disclosed in JP 2007-156355 A discharges the developer discontinuously, the degree of progress of deterioration of the developer in the developing device is unstable. Therefore, in the prior arts as disclosed in JP 2004-226658 A, JP 2006-220988 A, and JP 2007-156355 A, depending on the state of the charge amount of the toner included in the developer, the amount of the developer is not constant, and there is a fear that deterioration of image quality can not be prevented.

SUMMARY

The present disclosure has been made in view of such a situation, and is intended to prevent deterioration of image quality.

To achieve the abovementioned object, according to an aspect of the present invention, a developing device for forming an image by developing an electrostatic latent image formed on an image carrier with a developer, reflecting one aspect of the present invention comprises: a developing container that accommodates the developer, a developing roller that faces the image carrier, is disposed adjacent to the developing container, and conveys the developer accommodated in the developing container to the image carrier, and a developer discharging part that is provided in the developing container and discharges a part of the developer, wherein a discharge amount of the developer discharged by the developer discharging part is controlled on the basis of a charge amount of a toner included in the developer.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Hereinafter, one or more embodiments of the present disclosure will be described with reference to the drawings. However, the present disclosure is not limited to the disclosed embodiments.

First Embodiment

Figure 1:
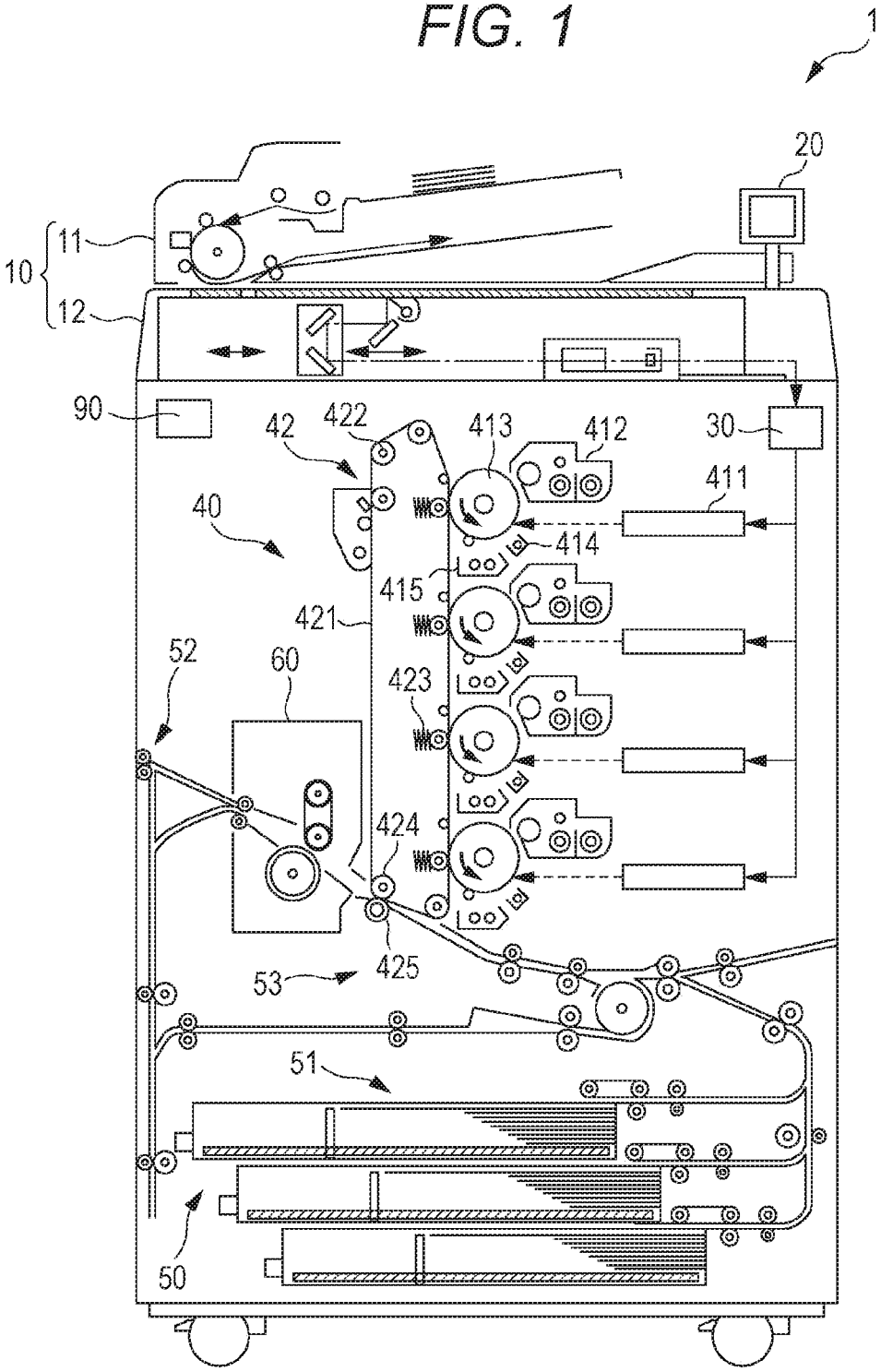
FIG. 1 is a diagram showing an example of the overall configuration of an image forming device according to a first embodiment of the present disclosure.
Figure 2:
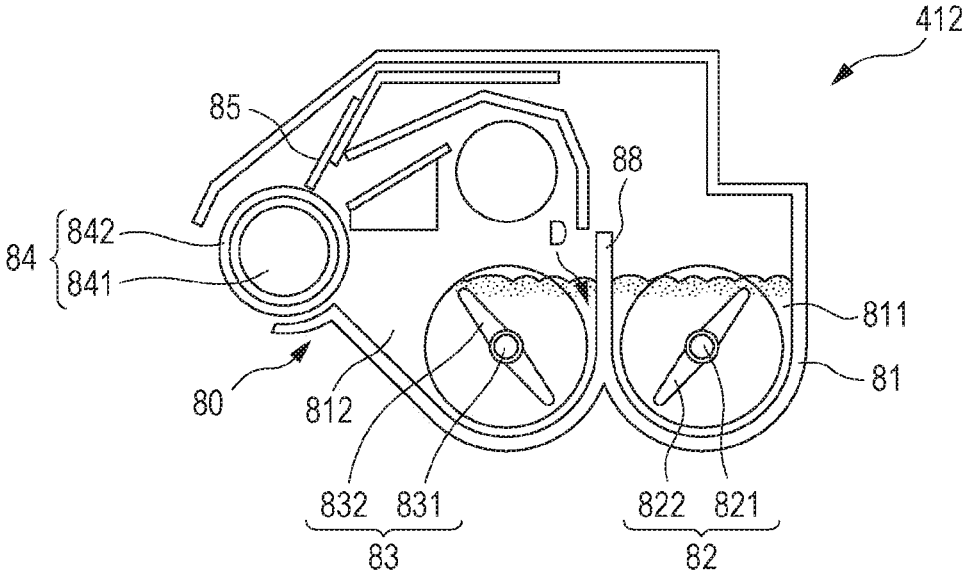
FIG. 2 is a diagram showing a configuration example of a developing device according to the first embodiment of the present disclosure.
Figure 3:
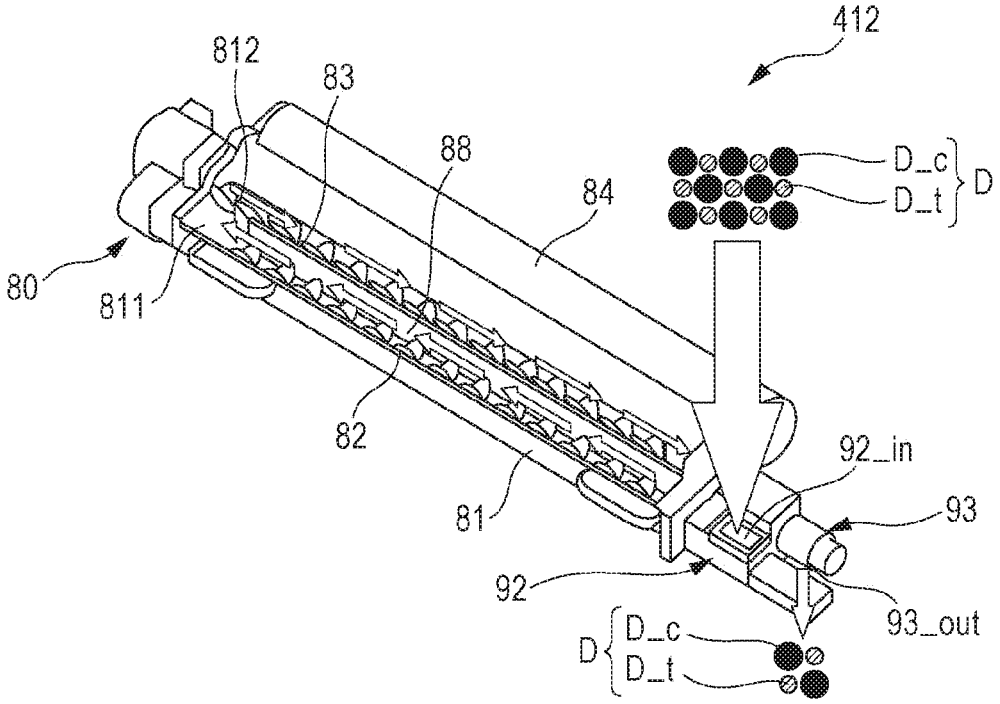
FIG. 3 is a perspective view showing an internal configuration example of the developing device according to the first embodiment of the present disclosure.
Figure 4:
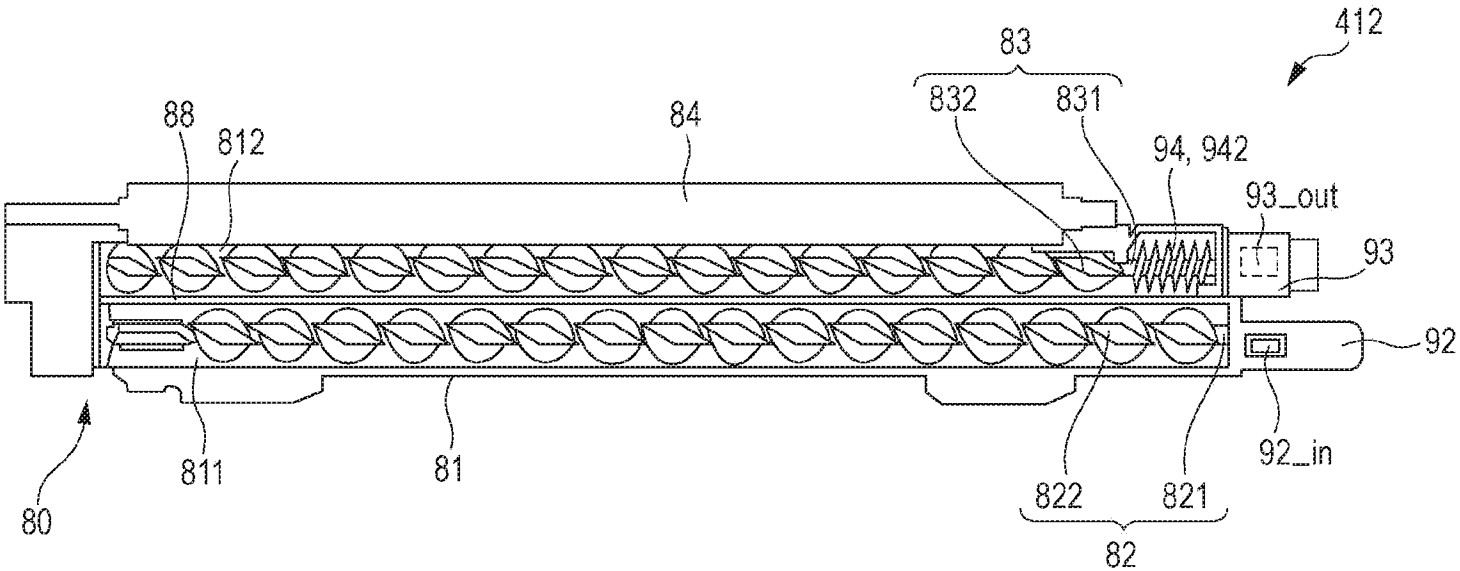
FIG. 4 is a top view showing the internal configuration example of the developing device according to the first embodiment of the present disclosure.
Figure 5:
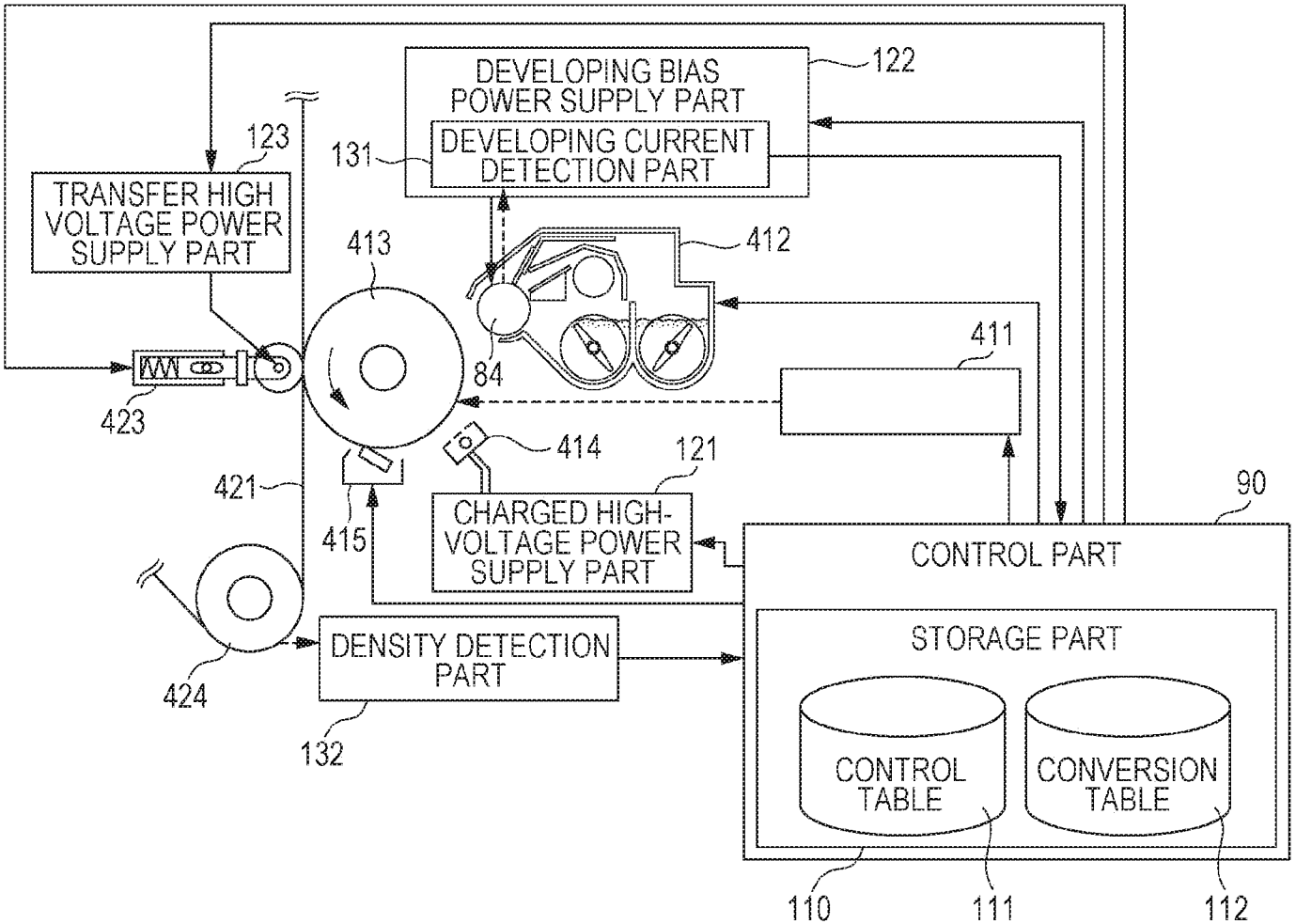
FIG. 5 is a diagram showing an example of a periphery and a control function of the developing device according to the first embodiment of the present disclosure.

FIG. 1 is a diagram showing an example of the overall configuration of an image forming device 1 according to a first embodiment of the present disclosure. FIG. 2 is a diagram showing a configuration example of a developing device 412 according to the first embodiment of the present disclosure. FIG. 3 is a perspective view showing an internal configuration example of the developing device 412 according to the first embodiment of the present disclosure. FIG. 4 is a top view showing the internal configuration example of the developing device 412 according to the first embodiment of the present disclosure. FIG. 5 is a diagram showing an example of a periphery and a control function of the developing device 412 according to the first embodiment of the present disclosure. The image forming device 1 forms a color image on a sheet by an intermediate transfer method using an electrophotographic process technology. The image forming device 1 performs a primary transfer of color toner images of each color of yellow (Y), magenta (M), cyan (C), and black (K) formed on the photosensitive body 413, onto an intermediate transfer belt 421 of an intermediate transfer part 42. The toner images of each color primarily transferred onto the intermediate transfer belt 421 are secondarily transferred onto the sheet after four colors are superimposed, and an image is formed on the sheet. The image forming device 1 employs a tandem method. The tandem method is a method of arranging the photosensitive bodies 413 corresponding to the four colors of Y, M, C. and K described above in series in a travel direction of the intermediate transfer belt 421, and transferring the toner images of each color sequentially to the intermediate transfer belt 421 in a single procedure.

The image forming device 1 includes an image reading part 10, an operation display part 20, an image processing part 30, an image forming part 40, a sheet conveying part 50, a fixing part 60, and a control part 90. The control part 90 includes a CPU, a ROM, a RAM, a storage part 110, and the like. The CPU reads a program from the ROM in accordance with processing contents, decompresses the program in the RAM, and cooperates with the decompressed program to control the operation of the image forming device 1. The storage part 110 is realized by a nonvolatile semiconductor memory such as, for example, a flash memory, or a had disk drive, and stores various data. Various data stored in the storage part 110 is referred to when the CPU controls the operation of the image forming device 1.

The image reading part 10 includes an automatic document feeding device 11, a document image scanning device 12, and the like. The automatic document feeding device 11 is referred to as an auto document feeder (ADF). The automatic document feeding device 11 conveys a document placed on a document tray by a conveyance mechanism and sends the document to the document image scanning device 12. The automatic document feeding device 11 can continuously read images of multiple sheets of documents placed on the document tray. When images of multiple sheets of documents are continuously read, the automatic document feeding device 11 can read both sides of each document by a sheet inverting mechanism. The document image scanning device 12 optically scans a document conveyed onto a contact glass from the automatic document feeding device 11 or a document placed on the contact glass. The document image scanning device 12 forms an image of reflected light from the document by optical scamming on a light receiving surface of a CCD sensor to read a document image formed on the document. The image reading part 10 generates input image data of the document image on the basis of a reading result by the document image scanning device 12. The input image data is fed to the image processing part 30, and the image processing part 30 performs preset image processing.

The image processing part 30 includes a circuit that performs digital image processing in accordance with various profiles set by initial setting, user setting, or the like, for the input image data. The image processing part 30 performs various correction processing such as, for example, gradation correction, color correction, or shading correction, compression processing or the like for the input image data. The image forming part 40 performs various processing on the basis of the input image data for which such various digital image processing has been performed. The image forming part 40 forms images of the toner of each color of Y component, M component, C component, and K component on the basis of the input image data. The image forming part 40 includes an exposure device 411, a developing device 412, a photosensitive body 413, a charging device 414, a drum cleaning device 415, and the like. The charging device 414 is charged by a charged high-voltage power supply part 121, and generates corona discharge. The photosensitive body 413 is charged by the corona discharge of the charging device 414. The exposure device 411 irradiates the photosensitive body 413 with laser light corresponding to the image of each color component, so that an electrostatic latent image of each color component is formed. The developing device 412 causes a toner D_t of each color component to adhere to the surface of the photosensitive body 413, so that the electrostatic latent image is visualized and a toner image is formed. The drum cleaning device 415 removes the toner D_t remaining on the surface of the photosensitive body 413 after the primary transfer. The photosensitive body 413 is formed of, for example, an organic photosensitive body in which a photosensitive layer formed of a resin containing an organic photoconductor is formed on an outer peripheral surface of a drum-shaped metal base, and is provided so as to extend in a width direction of the sheet to be conveyed. As the resin forming the photosensitive layer, for example, polycarbonate or the like can be exemplified. In the embodiment shown in FIG. 1 and the like, an example in which the photosensitive body 413 has a drum shape has been described. However, the present invention is not limited to this, and the photosensitive body 413 may have a belt shape. That is, it is sufficient that the photosensitive body 413 functions as an image carrier on which an electrostatic latent image is formed by laser light emitted from the exposure device 411.

The intermediate transfer part 42 includes an intermediate transfer belt 421, a support roller 422, a primary transfer roller 423, a backup roller 424, and a secondary transfer roller 425. A primary transfer nip formed by the photosensitive body 413 and the primary transfer roller 423 pressed against each other via the intermediate transfer belt 421 primarily transfers the toner image from the photosensitive body 413 to the intermediate transfer belt 421. Specifically, the primary transfer roller 423 urges the intermediate transfer belt 421 from a back surface toward the photosensitive body 413, and a preset constant voltage is applied to the primary transfer roller 423 by a transfer high voltage power supply part 123. A secondary transfer nip formed by the backup roller 424 and the secondary transfer roller 425 pressed against each other via the intermediate transfer belt 421 secondarily transfers the toner image from the intermediate transfer belt 421 to the sheet. The fixing part 60 heats and pressurizes the toner image transferred onto the sheet to form an image on the sheet. The sheet conveying part 50 includes a sheet feeding part 51, a sheet discharging part 52, a conveying path part 53, and the like. Note that the intermediate transfer belt 421 may have any structure as long as the structure functions as a transfer belt.

The developing device 412 includes a developing device main body 80, a developer feeding part 92, a developer discharging part 93, and the like. The developer feeding part 92 is provided at the most upstream position in a developer conveyance direction of an axial direction end part of a developer feeding path of the developing device main body 80, has a developer feeding port 92_in, and feeds the two-component developer D including a toner D_t and a carrier D_c from the developer feeding port 92_in to the developing device main body 80. The developing device main body 80 includes a developing container 81, a stirring screw 82, a feeding screw 83, a developing roller 84, a regulating member 85, and the like. The developing container 81 accommodates the developer D fed from the developer feeding part 92. The inside of the developing container 81 is partitioned into a stirring path 811 and a feeding path 812 by a partition wall 88. The stirring path 811 and the feeding path 812 extend parallel to an axial direction of the developing roller 84. The stirring path 811 and the feeding path 812 communicate with each other at both axial end parts of the developing roller 84 so that the developer D is circulated and conveyed. That is, the conveyance direction of the developer D in the stirring path 811 is opposite to the conveyance direction of the developer D in the feeding path 812. The developer D that has become excessive as being fed from the developer feeding part 92 is discharged from the developer discharging part 93 to a developer recovery flow path not shown. The developer discharging part 93 is provided at the most downstream position in the developer conveyance direction in the axial direction end part of the developer feeding path of the developing device main body 80 and has a developer discharging port 93_out. Therefore, a part of the developer D is discharged via the developer discharging port 93_out.

The stirring screw 82 is disposed along the axial direction of the developing roller 84 in the stirring path 811. The stirring screw 82 has a configuration in which blades 822 are spirally formed at a constant pitch over substantially the entire length of an axial center 821 connected to a driving motor not shown. The stirring screw 82 stirs the developer D. Specifically, as the stirring screw 82 rotates, the developer D is conveyed in one direction while being stirred. The feeding screw 83 is disposed along the axial direction of the developing roller 84 in the feeding path 812. The feeding screw 83 has a similar configuration to that of the stirring screw 82. That is, the feeding screw 83 has a configuration in which blades 832 are spirally formed at a constant pitch over substantially the entire length of an axial center 831 connected to a driving motor not shown. The feeding screw 83 is provided between the developing roller 84 and the stirring screw 82 and feeds the developer D stirred by the stirring screw 82 to the developing roller 84. Specifically, as the feeding screw 83 rotates, the toner D_t and the carrier D_c are conveyed in one direction while being stirred. A reverse winding screw 94 is provided between an end part of the feeding screw 83 on the downstream side in the developer conveyance direction and the developer discharging part 93. The reverse winding screw 94 has a plurality of blades 942 reversely wound to the stirring screw 82 and the feeding screw 83, has the same axial center 831 as that of the feeding screw 83, and rotates together with the feeding screw 83. Therefore, the stirring screw 82 and the feeding screw 83 have a longer conveying distance of the developer D than that of the reverse winding screw 94, so that the rotation speeds of the stirring screw 82 and the feeding screw 83 are affected by a conveyance force of the developer D. Therefore, when the rotation speed of the stirring screw 82 and the feeding screw 83 is increased, the developer D easily climbs over the reverse winding screw 94, and the discharge amount of the developer D increases. On the other hand, when the rotation speed of the stirring screw 82 and the feeding screw 83 is decreased, the developer D is easy to be pushed back by the reverse winding screw 94, and the discharge amount of the developer D decreases. That is, the developing device 412 has a configuration of a screw conveyance force balancing type discharge mechanism.

When the developer D is conveyed in the stirring path 811 and the feeding path 812, the toner D_t and the carrier D_c included in the developer D are in frictional contact and are charged to opposite polarities from each other. Here, it is assumed that the carrier D_c is charged to positive polarity and the toner D_t is charged to negative polarity. The negatively charged toner D_t adheres to the periphery of the positively charged carrier D_c mainly due to the electrical attraction force between them. The developer D is fed to the developing roller 84 in the course of being conveyed along the feeding path 812. The developing roller 84 is disposed opposite to the photosensitive body 413 and adjacent to the developing container 81, and conveys the developer D accommodated in the developing container 81 to the photosensitive body 413. That is, the developing roller 84 feeds the developer D to the photosensitive body 413 on which the electrostatic latent image is formed. Above the developing roller 84, a regulating member 85 is disposed so as to face the developing roller 84 while being spaced apart from the developing roller 84 by a certain distance. The regulating member 85 extends in parallel with the developing roller 84, and is a plate-like member formed of a magnetic material such as stainless steel, for example. The developing roller 84 includes a magnet roller 841 and a developing sleeve 842. The magnet roller 841 generates a fixed magnetic field. The developing sleeve 842 is rotatable, and a voltage obtained by superimposing a DC voltage on an AC voltage is applied to the developing sleeve 842 from a developing bias power supply part 122. A developing current detection part 131 detects a developing current flowing between the developing roller 84 and the photosensitive body 413 during development. The developing current is generated when the toner D_t moves from the surface of the developing roller 84 to the photosensitive body 413 during development. The developing current is proportional to the total charge amount per unit time of the moved toner D_t. Therefore, the total charge amount of the developed toner D_t can be detected by detecting the developing current.

A density detection part 132 is provided in further downstream than the developing device 412 on the most downstream side in a rotation direction on the intermediate transfer belt 421. The density detection part 132 is formed of a reflection type photosensor. The density detection part 132 detects an optical reflection density of a patch image of the toner D_t of each color of Y, M, C, and K formed on the intermediate transfer belt 421. A conversion table 112 included in the storage part 110 has data for specifying a correspondence relationship between an optical reflection density and a toner adhesion amount. Therefore, the toner adhesion amount can be obtained from the optical reflection density by referring to the conversion table 112. Therefore, the charge amount per unit adhesion amount of the toner D_t can be obtained as the charge amount of the toner D_t from a relationship between the value of the toner adhesion amount obtained by the density detection part 132 and the total charge amount per unit time of the toner D_t obtained from the developing current detected by the developing current detection part 131. In the control table 111, output values of a development condition and a transfer condition in a normal image forming mode, output values of the transfer condition in a mode for obtaining the charge amount of the toner D_t included in the developer D, and the like are set. The transfer condition is setting of an output value from the transfer high voltage power supply part 123 in the normal image forming mode, or an output value from the transfer high voltage power supply part 123 in a mode for obtaining the charge amount of the toner D_t included in the developer D, and an urging force of the primary transfer roller 423. Although not shown, the control part 90 has a function of a timer for measuring time and elapsed time.

Figure 6:
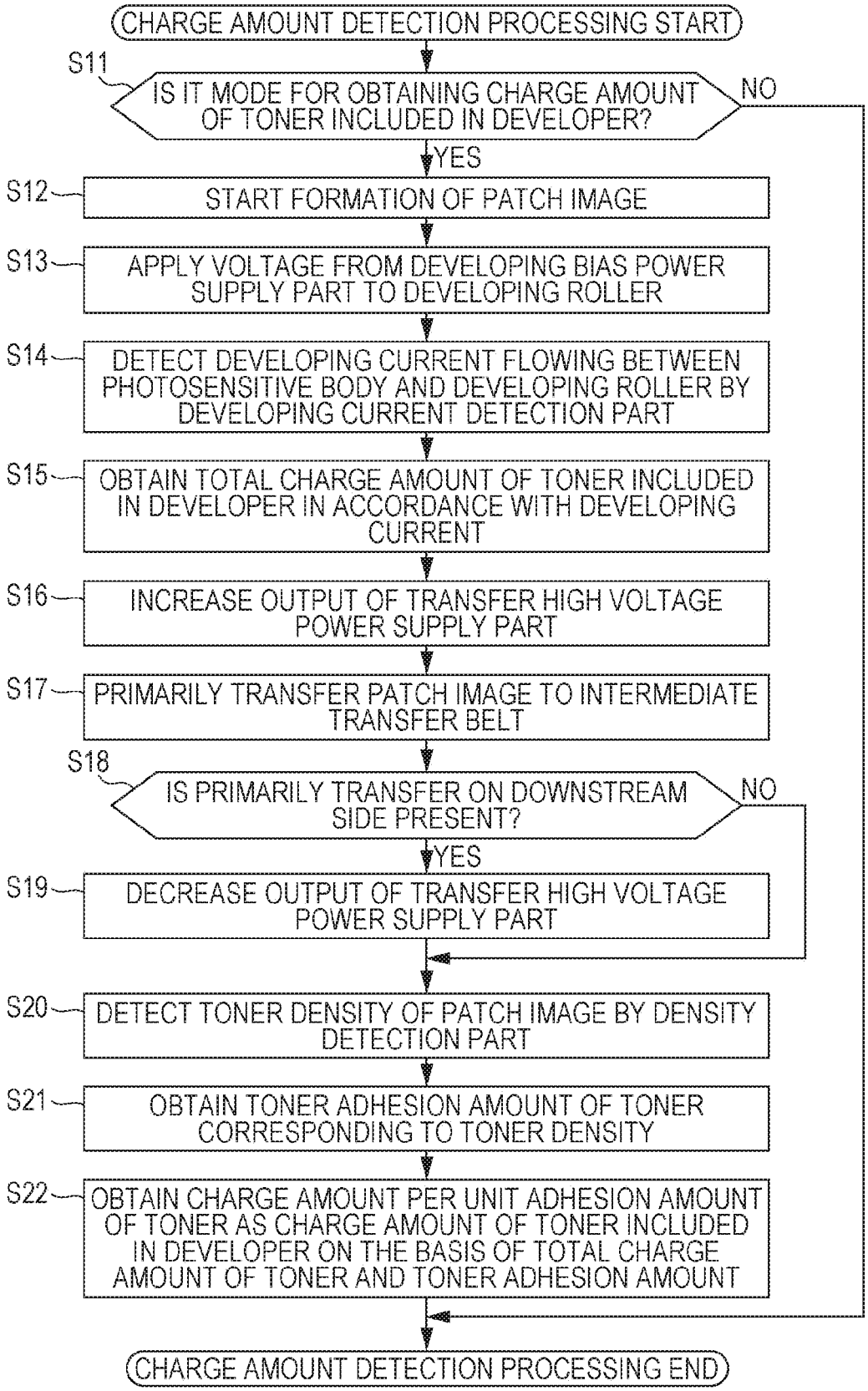
FIG. 6 is a flowchart illustrating an example of charge amount detection processing according to the first embodiment of the present disclosure.

FIG. 6 is a flowchart illustrating an example of charge amount detection processing according to the first embodiment of the present disclosure. In step S11, the image forming device 1 determines whether it is a mode for obtaining the charge amount of the toner D_t included in the developer D. When the image forming device 1 determines that it is a mode for obtaining the charge amount of the toner D_t included in the developer D (step S11; Y), the processing proceeds to step S12. When the image forming device 1 determines that it is not a mode for obtaining the charge amount of the toner D_t included in the developer D (step S11; N), the image forming device 1 terminates the processing and transition is made to a state where the toner image can be formed on the basis of the image data for printing. In step S12, the image forming device 1 starts forming a patch image. In step S13, the image forming device 1 applies a voltage from the developing bias power supply part 122 to the developing roller 84. In step S4, the image forming device 1 detects the developing current flowing between the photosensitive body 413 and the developing roller 84 by the developing current detection part 131. In step S15, the image forming device 1 obtains the total charge amount of the toner D_t included in the developer D in accordance with the developing current. In step S16, the image forming device 1 increases the output of the transfer high voltage power supply part 123. In step S17, the image forming device 1 primarily transfers a patch image to the intermediate transfer belt 421. In step S18, the image forming device 1 determines whether primary transfer on the downstream side is present. When determining that primary transfer on the downstream side is present (step S18; Y), the image forming device 1 proceeds to processing of step S19, decreases the output of the transfer high voltage power supply part 123 in step S19, and proceeds to processing of step S20. When determining that primary transfer on the downstream side is not present (step S18; N), the image forming device 1 proceeds to processing of step S20. In step S20, the image forming device 1 detects the toner density of the patch image by the density detection part 132. In step S21, the image forming device 1 obtains the toner adhesion amount of the toner D_t corresponding to the toner density. In step S22, the image forming device 1 obtains the charge amount per unit adhesion amount of the toner D_t as the charge amount of the toner D_t included in the developer D on the basis of the total charge amount of the toner D_t and the toner adhesion amount, and terminates the processing.

Figure 7:
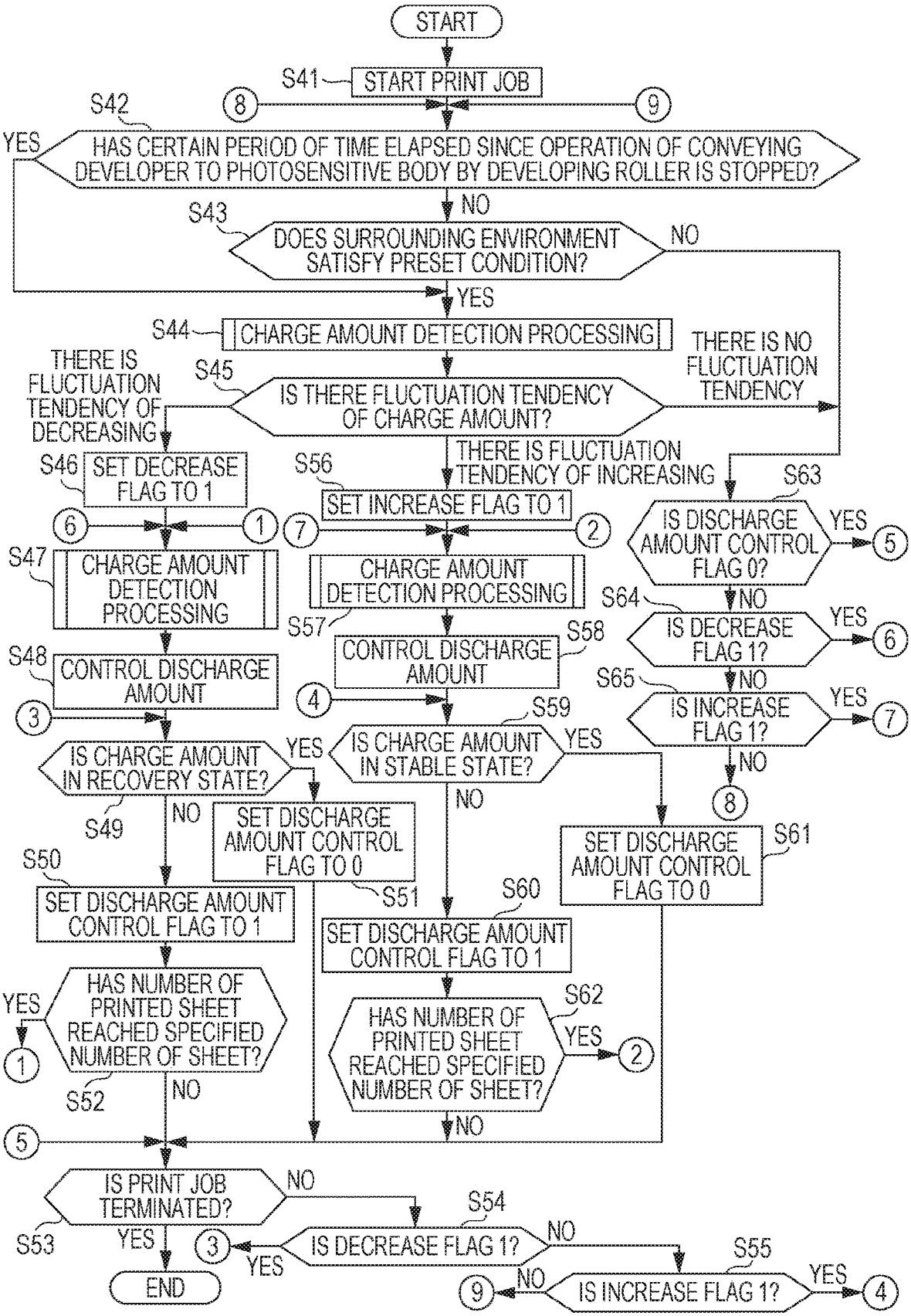
FIG. 7 is a flowchart illustrating an example of discharge amount control of a developer according to the first embodiment of the present disclosure.

FIG. 7 is a flowchart illustrating an example of discharge amount control of the developer D according to the first embodiment of the present disclosure. The processing of steps S41 to S65 is automatically performed by the image forming device 1 during printing. In step S41, the control part 90 starts a print job. In step S42, the control part 90 determines whether a certain period of time has elapsed since the stop of the operation of conveying the developer D to the photosensitive body 413 by the developing roller 84. When determining that a certain period of time has elapsed since the stop of the operation of conveying the developer D to the photosensitive body 413 by the developing roller 84 (step S42; Y), the control part 90 proceeds to processing of step S44, performs the charge amount detection processing in step S44, and proceeds to the processing of step S45. When determining that a certain period of time has not elapsed since the stop of the operation of conveying the developer D to the photosensitive body 413 by the developing roller 84 (step S42; N), the control part 90 proceeds to processing of step S43, and determines whether a surrounding environment satisfies a preset condition in step S43. When determining that the surrounding environment satisfies the preset condition (step S43; Y), the control part 90 proceeds to processing of step S44, performs the charge amount detection processing in step S44, and proceeds to processing of step S45. When the control part 90 determines that the surrounding environment does not satisfy the preset condition (step S43; N), the control part 90 proceeds to processing of step S63. In step S63, the control part 90 determines whether a discharge amount control flag is 0. When determining that the discharge amount control flag is 0 (step S63; Y), the control part 90 proceeds to processing of step S53. When determining that the discharge amount control flag is not 0 (step S63; N), the control part 90 proceeds to processing of step S64. In step S64, the control part 90 determines whether a decrease flag is 1. When determining that the decrease flag is 1 (step S64; Y), the control part 90 proceeds to processing of step S47. When determining that the decrease flag is not 1 (step S64; N), the control part 90 proceeds to processing of step S65. In step S65, the control part 90 determines whether an increase flag is 1. When determining that the increase flag is 1 (step S65; Y), the control part 90 proceeds to processing of step S57. When determining that the increase flag is not 1 (step S65; N), the control part 90 returns to the processing of step S42.

In step S45, the control part 90 determines the fluctuation tendency of the charge amount. When the fluctuation tendency of the charge amount tends to decrease due to high temperature and high humidity or leaving for a long period or the like, the control part 90 proceeds to processing of step S46 and performs processing of steps S46 to S54. The object of the processing from steps S46 to S54 is to control the discharge amount of the developer D until the charge amount is recovered. When the print job is completed, the discharge amount control processing is not necessarily terminated. For example, if the charge amount has not been recovered at the end of the print job, it is determined that the fluctuation tendency of the charge amount tends to decrease, at the start of the next printing, and the processing of steps S47 to S54 is performed. Specifically, in step S46, the control part 90 sets the decrease flag to 1. In step S47, the control part 90 performs the charge amount detection processing. In step S48, the control part 90 controls the discharge amount of the developer D. Details of the control of the discharge amount of the developer D will be described later with reference to FIG. 9. In step S49, the control part 90 determines whether the charge amount is in a recovery state. When determining that the charge amount is in the recovery state (step S49; Y), the control part 90 proceeds to processing of step S51, sets the discharge amount control flag to 0 in step S51, and proceeds to processing of step S53. When determining that the charge amount is not in the recovery state (step S49; N), the control part 90 proceeds to processing of step S50. In step S50, the control part 90 sets the discharge amount control flag to 1 and proceeds to processing of step S52. In step S52, the control part 90 determines whether the number of printed sheets has reached the specified number of sheets. When determining that the number of printed sheets has reached the specified number of sheets (step S52; Y), the control part 90 returns to the processing of step S47. When determining that the number of printed sheets has not reached the specified number of sheets (step S52; N), the control part 90 proceeds to processing of step S53. In step S53, the control part 90 determines whether the print job is terminated. When determining that the print job is terminated (step S53; Y), the control part 90 terminates the processing of steps S41 to S65, and the processing is started again from step S41 upon the start of the next print job. When determining that the print job is not terminated (step S53; N), the control part 90 proceeds to processing of step S54. In step S54, the control part 90 determines whether a decrease flag is 1. When determining that the decrease flag is 1 (step S54; Y), the control part 90 proceeds to processing of step S49. When determining that the decrease flag is not 1 (step S54; N), the control part 90 proceeds to processing of step S55. In step S55, the control part 90 determines whether an increase flag is 1. When determining that the increase flag is 1 (step S55; Y), the control part 90 proceeds to processing of step S59. When determining that the increase flag is not 1 (step S55; N), the control part 90 returns to the processing of step S42.

On the other hand, when the fluctuation tendency of the charge amount tends to increase due to a decrease in the toner density, an environmental change to a low humidity, or the like, the control part 90 proceeds to processing of step S56, and performs processing of steps S56 to S62 and steps S53 to step S55. The object of the processing from steps S56 to S62 and steps S53 to S55 is to perform the discharge amount control of the developer D until the charge amount is stabilized. When the print job is completed, the discharge amount control processing is not necessarily terminated. For example, if the charge amount has not been stabilized at the end of the print job, it is determined that the fluctuation tendency of the charge amount tends to increase at the start of the next printing, and the processing of steps S57 to S62 and steps S53 to S55 is performed. Specifically, in step S56, the control part 90 sets the increase flag to 1. In step S57, the control part 90 performs the charge amount detection processing. In step S58, the control part 90 controls the discharge amount of the developer D. In step S59, the control part 90 determines whether the charge amount is in a stable state. When determining that the charge amount is in the stable state (step S59; Y), the control part 90 proceeds to processing of step S61, sets the discharge amount control flag to 0 in step S61, and proceeds to processing of step S53. When determining that the charge amount is not in the stable state (step S59; N), the control part 90 proceeds to processing of step S60. In step S60, the control part 90 sets the discharge amount control flag to 1, and proceeds to processing of step S62. In step S62, the control part 90 determines whether the number of printed sheets has reached the specified number of sheets. When the control part 90 determines that the number of printed sheets has reached the specified number of sheets (step S62; Y), the control part 90 returns to the processing of step S57. When determining that the number of printed sheets has not reached the specified number of sheets (step S62; N), the control part 90 proceeds to processing of step S53, and performs the processing of step S53 as described above. When there is no fluctuation tendency of the charge amount, the control part 90 proceeds to the processing of step S63 and performs the processing of step S63 as described above.

Figure 8:
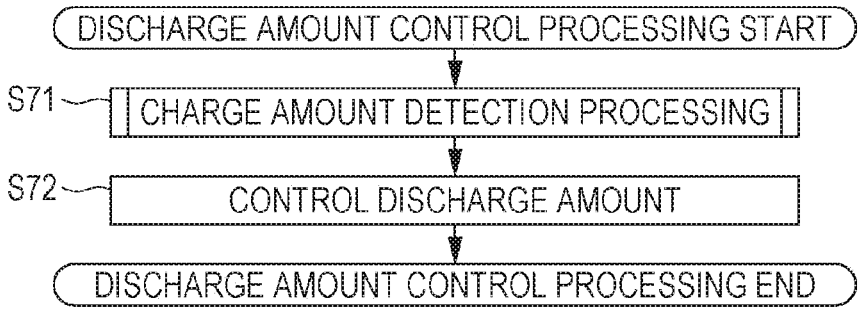
FIG. 8 is a flowchart illustrating an example of discharge amount control of the developer by manual control according to the first embodiment of the present disclosure.

FIG. 8 is a flowchart illustrating an example of discharge amount control of the developer D by manual control according to the first embodiment of the present disclosure. The processing of steps S71 and S72 is processing of manually performing the discharge amount control when the image forming device 1 is not forming an image, by an operator. For example, when a button for proceeding to the manual mode is operated, the processing of step S71 and S72 is performed. In step S71, the control part 90 performs the charge amount detection processing. In step S72, the control part 90 controls the discharge amount of the developer D and terminates the discharge amount control processing.

In the above description, in the developing device 412 employing the trickle developing method, the bulk density changes as the charge amount of the developer D changes. Therefore, the amount of the developer D changes due to excessive discharge or insufficient discharge of the developer D. In particular, after leaving the image forming device 1 in a high temperature and high humidity environment, or after leaving the image forming device 1 for a long period of time, the charge amount of the toner D_t greatly decreases as compared with before charging. Therefore, since the amount of the developer D that has been balanced before the leaving greatly decreases particularly in the case of excessive discharge, the amount of the developer D that can be fed to the developing roller 84 is insufficient. Therefore, screw unevenness by the stirring screw 82 and the feeding screw 83 may occur. When the amount of the developer D changes, a torque of the developing device 412 changes, or the toner density becomes unstable. When the amount of the developer D is unstable, the image quality is deteriorated. Therefore, in the developing device 412 employing the trickle developing method, it is necessary to hold the amount of the developer D constant.

Therefore, in the developing device 412, the discharge amount of the developer D discharged by the developer discharging part 93 is controlled on the basis of the charge amount of the toner D_t included in the developer D. That is, the bulk density can be accurately detected by detecting the charge amount of the toner D_t included in the developer D, so that the discharge amount control of the developer D can be accurately performed. In particular, when the charge amount of the toner D_t decreases after the image forming device 1 is left, the charge amount of the toner D_t is detected, and feedback is given to the control of the discharge amount of the developer D before the start of printing, even when the bulk density of the developer D before leaving of the image forming device 1 has greatly increased, excessive discharge or insufficient discharge of the developer D immediately after the start of printing can be prevented. Therefore, problems due to changes in the developer D can be prevented.

In other words, since the discharge amount of the developer D discharged by the developer discharging part 93 is controlled on the basis of the charge amount of the toner D_t included in the developer D, the bulk density can be accurately detected, so that the discharge amount control of the developer D can be accurately performed, the amount of the developer D can be kept constant, and thereby, deterioration in image quality can be prevented.

The total charge amount of the toner D_t included in the developer D is obtained in accordance with the developing current. Since the developing current is proportional to the total charge amount per unit time of the moved toner D_t, the total charge amount of the toner D_t can be accurately obtained from the developing current.

The charge amount of the toner D_t included in the developer D is obtained on the basis of the total charge amount of the toner D_t included in the developer D and the toner adhesion amount of the toner D_t corresponding to the toner density detected by the density detection part 132. It is possible to accurately detect the adhesion amount of the toner image on the plurality of photosensitive bodies 413 by one density detection part 132 provided on the intermediate transfer belt 421. Therefore, it is possible to accurately detect the charge amount of the toner D_t accommodated in the plurality of developing devices 412.

Further, the discharge amount of the developer D is controlled in accordance with the fluctuation tendency of the charge amount of the toner D_t included in the developer D. For example, when printing is continued, the charge amount of the toner D_t is detected for each specified number of sleets and feedback is given to the control of the discharge amount of the developer D, so that, even when the charge amount of the toner D_t increases and the bulk density returns to a state of before leaving, the discharge amount of the developer D can always be controlled to an appropriate discharge amount. By performing such control also when the charge amount of the toner D_t due to leaving is not decreased, for example, even in a state in which the charge amount of the toner D_t tends to increase, specifically, when the toner density is low, or in an environment of low temperature and low humidity, the discharge amount of the developer D can be optimized, so that the amount of the developer D is stabilized. In this way, since the discharge amount of the developer D is controlled on the basis of the charge amount itself of the toner D_t, the amount of the developer D is controlled with higher accuracy.

When a certain period of time has elapsed since the operation of conveying the developer D to the photosensitive body 413 by the developing roller 84 is stopped, the charge amount of the toner D_t included in the developer D is obtained. Even when the charge amount of the toner D_t is greatly changed by leaving for a certain period of time, since the charge amount of the toner D_t is obtained before reprinting, the discharge amount of the developer D is controlled in accordance with the charge amount of the toner D_t immediately before the start of printing.

When the surrounding environment satisfies the preset condition, the charge amount of the toner D_t included in the developer D is obtained. For example, since the charge amount of the toner D_t is obtained before reprinting in accordance with environmental changes such as high temperature and high humidity or low temperature and low humidity, the discharge amount of the developer D is controlled in accordance with the charge amount of the toner D_t immediately before the start of printing while the environmental changes are coped with.

Figure 9:
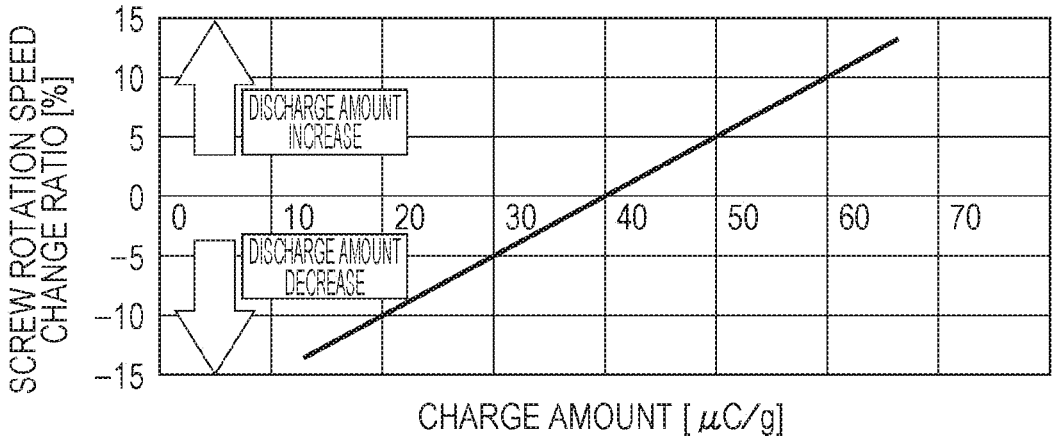
FIG. 9 is a diagram showing an example of discharge amount control of the developer by a screw conveyance force balance type discharge mechanism according to the first embodiment of the present disclosure.

FIG. 9 is a diagram showing an example of discharge amount control of the developer D by a screw conveyance force balance type discharge mechanism according to the first embodiment of the present disclosure.

Comparative Example 1

Printing of original coverage 10% and A4 equivalent 20000 prints was carried out. Thereafter, when the image forming device 1 was left in an environment of high temperature and high humidity and reprinting of original coverage 10% was carried out one week later, the bulk density of the developer D increases due to a decrease in the charge amount of the toner D_t, the developer D is excessively discharged from the developer discharging part 93, and after 100 prints, image density unevenness was generated due to insufficiency of the developer D. That is, the developing container 81 is provided with a path for increasing the discharge amount of the developer D in accordance with the decrease in the charge amount of the toner D_t included in the developer D accommodated in the developing container 81.

Improvement Example 1

It was clarified that, when leaving was performed similarly, and reprinting of original coverage 10% was carried out after one week, before the reprinting, the charge amount of the toner D_t was 40 μC/g before leaving, whereas the charge amount was decreased to 25 μC/g after the leaving. Therefore, as shown in FIG. 9, the screw rotation speed was decreased by 7.5% from the center value, the conveyance force by the developer D toward the developer discharging port 93_out was decreased, and excessive discharge of the developer D was prevented. Even after 500 prints, no problem occurred. That is, as the charge amount of the toner D_t included in the developer D decreases, it is possible to cope with the change in the discharge amount of the developer D due to the decrease in the charge amount by reducing the discharge amount of the developer D.

Comparative Example 2

Printing of original coverage 0.3% and A4 equivalent 20000 prints was carried out. Thereafter, when the image forming device 1 was left and reprinting of original coverage 10% was carried out one week later, the bulk density of the developer D increases due to a decrease in the charge amount of the toner D_t, the developer D is excessively discharged from the developer discharging part 93, and after 50 prints, image density unevenness was generated due to insufficiency of the developer D. That is, the developing container 81 is provided with a path for increasing the discharge amount of the developer D in accordance with the decrease in the charge amount of the toner D_t included in the developer D accommodated in the developing container 81.

Improvement Example 2

It was clarified that, when leaving was performed similarly, and reprinting of original coverage 10% was carried out after one week, before the reprinting, the charge amount of the toner D_t was 40 μC/g before leaving, whereas the charge amount was decreased to 20 μC/g after the leaving. Therefore, as shown in FIG. 9, the screw rotation speed was decreased by 10% from the center value, the conveyance force by the developer D toward the developer discharging port 93_out was decreased, and excessive discharge of the developer D was prevented. Even after 500 prints, no problem occurred. That is, as the charge amount of the toner D_t included in the developer D decreases, it is possible to cope with the change in the discharge amount of the developer D due to the decrease in the charge amount by reducing the discharge amount of the developer D. It is possible to accurately perform the discharge amount control of the developer D in accordance with the deterioration state of the developer D of the previous history.

Comparative Example 3

Further printing was continued in the improvement example 1 and the improvement example 2. As the charge amount of the toner D_t gradually increases and recovers, the bulk density decreases, so that the discharge amount of the developer D decreases. The amount of the developer D becomes excessive after 3000 prints in the improvement example 1, and after 5000 prints in the improvement example 2, so that torque up occurred.

Improvement Example 3

Similarly, while continuing printing, the charge amount of the toner D_t is detected every 1000 prints as the specified number of sheets. In the case where the charge amount of the toner D_t increases, as shown in FIG. 9, the screw rotation speed was increased and the conveyance force by the screw rotation speed of the developer D toward the developer discharging port 93_out was increased, so that discharging insufficiency of the developer D was prevented. The charge amount of the toner D_t recovered to the same amount as that before the leaving, for every 6000 prints as the specified number of sheets in the improvement example 1, and for every 10000 prints as the specified number of sheets in the improvement example 2. Thereafter, the charge amount of the toner D_t was not detected. However, even after 20000 prints, no image density unevenness occurred. That is, when the developing container 81 is provided with a path for increasing the discharge amount of the developer D in accordance with the increase in the charge amount of the toner D_t included in the developer D accommodated in the developing container 81, as the discharge amount of the toner D_t included in the developer D increases, the discharge amount of the developer D increases, and thereby, an increase in the charge amount of the toner D_t due to the charge amount recovery of the toner D_t during printing can be coped with. As the charge amount of the toner D_t included in the developer D approaches the recovery state, the discharge amount of the developer D is decreased, so that the discharge amount of the developer D can be smoothly approached a fixed amount as time elapses.

Comparative Example 4

Printing of original coverage 10% and A4 equivalent 10000 prints was carried out in high temperature and high humidity. Thereafter, assuming that the control of the air conditioner was turned on in the environment during the rainy season, the image forming device 1 was left for two hours at normal temperature and normal humidity. Thereafter, when reprinting was of original coverage 10% was carried out, the bulk density of the developer D decreases due to an increase in the charge amount of the toner D_t, the discharge amount of the developer D from the developer discharging port 93_out decreases, and the amount of the developer D becomes excessive after 3000 prints, so that the torque up occurred.

Improvement Example 4

At the time of reprinting at normal temperature and normal humidity, the charge amount of the toner D_t is detected. The value of when the charge amount of the toner D_t detected in advance under high temperature and high humidity was 30 μC/g, whereas dehumidification is performed at normal temperature and normal humidity, and the charge amount of the toner D_t increased to 35 μC/g. As shown in FIG. 9, the screw rotation speed change ratio was changed from −5% to −2.50%. While continuing printing, the charge amount of the toner D_t was detected for every 1000 prints as the specified number of sheets. As the dehumidification of the developer D advances, the charge amount of the toner D_t further increases, whereas, as shown in FIG. 9, the screw rotation speed was increased and the conveyance force by the screw rotation speed of the developer D toward the developer discharging port 93_out was increased, so that discharging insufficiency of the developer D was prevented. After 10000 prints, the increase in the charge amount of the toner D_t was stopped and stabilized. Thereafter, the charge amount of the toner D_t was not detected. However, even after 20000 prints, no image density unevenness occurred. That is, when the developing container 81 is provided with a path for reducing the discharge amount of the developer D in accordance with an increase in the charge amount of the toner D_t included in the developer D accommodated in the developing container 81, as the charge amount of the toner D_t included in the developer D increases, the discharge amount of the developer D is increased, so that it is also possible to cope with an increase in charge amount due to environmental variations and the like. As the charge amount of the toner D_t included in the developer D approaches the stable state, the discharge amount of the developer D is decreased, so that the discharge amount of the developer D is smoothly approached a fixed amount as time elapses.

Second Embodiment

Figure 10:
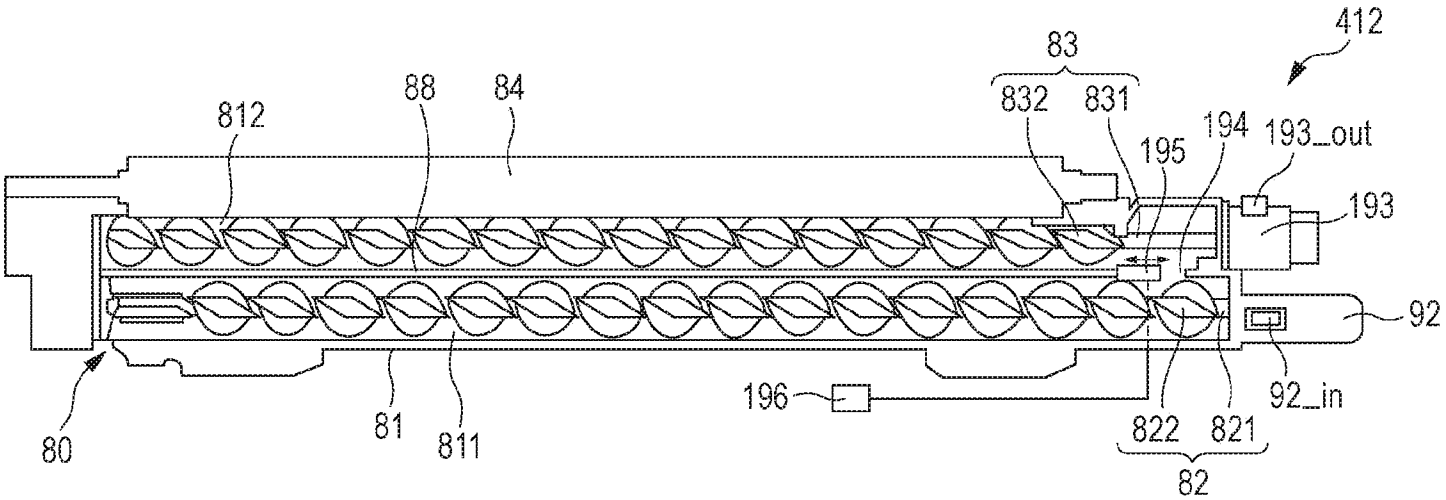
FIG. 10 is a diagram showing an example of an overflow type discharge mechanism according to a second embodiment of the present disclosure.

In the second embodiment, the same components as those of the first embodiment are denoted by the same reference numerals, and description thereof is omitted. In the second embodiment, since the processing of controlling the discharge amount of the developer D by the manual control according to the first embodiment is performed in the similar manner, the description thereof will be omitted. In the second embodiment, the configuration of the developer discharging part 193 is different from that of the developer discharging part 93 in the first embodiment. Therefore, in the second embodiment, mainly the configuration and function of the developer discharging part 193 will be specifically described. FIG. 10 is a diagram showing an example of an overflow type discharge mechanism according to a second embodiment of the present disclosure. As shown in FIG. 10, a partition member 195 is provided in a communicating part 194 provided in a portion of the partition wall 88 close to the developer discharging pan 193 and the developer feeding part 92. In the partition member 195, the opening width of the communicating part 194 can be freely adjusted by a solenoid 196. As shown in FIG. 10, a developer discharging port 193_out is provided in the developer discharging part 193. The developer discharging port 193_out is provided at a position of a certain height from a bottom surface of the developing container 81, and discharges the developer D overflowing when the liquid level of the developer D accommodated in the developing container 81 exceeds the certain height. For example, when the partition member 195 is set to narrow, the developer D easily accumulates in the developing container 81, and the liquid level of the developer D rises, so that the discharge amount of the developer D increases. On the other hand, when the partition member 195 is set to wide, the developer D is hard to accumulate in the developing container 81, and the liquid level of the developer D falls, so that the discharge amount of the developer D decreases. When the bulk density of the developer D increases due to a decrease in the charge amount of the toner D_t, the discharge amount of the developer D discharged from the developer discharging port 193_out becomes excessively small. On the other hand, when the bulk density of the developer D decreases due to an increase in the charge amount of the toner D_t, the discharge amount of the developer D discharged from the developer discharging port 193_out becomes excessive. Therefore, the overflow type discharge mechanism has a configuration opposite to the screw conveyance force balance type.

Figure 11:
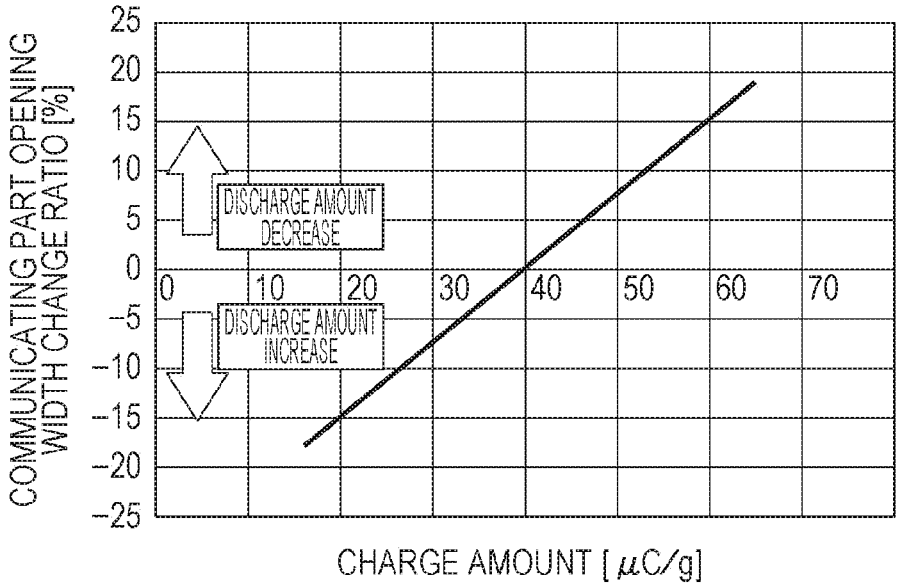
FIG. 11 is a diagram showing an example of discharge amount control of the developer by the overflow type discharge mechanism according to the second embodiment of the present disclosure.

FIG. 11 is a diagram showing an example of discharge amount control of the developer D by the overflow type discharge mechanism according to the second embodiment of the present disclosure. A state in which the partition member 195 completely closes the communicating part 194 is set to a change ratio of −100%, a state in which the opening width is expanded most is set to 100%, and a middle value thereof is set to be a center value 0%. The similar results to that described above can be obtained for the comparative examples 1 to 4 described above. That is, when the developing container 81 is provided with a path for reducing the discharge amount of the developer D in accordance with a decrease in the charge amount of the toner D_t included in the developer D accommodated in the developing container 81, as the charge amount of the toner D_t included in the developer D decreases, the discharge amount of the developer D is increased. Therefore, it is possible to cope with the change in the discharge amount of the developer D due to the decrease in the charge amount. It is possible to accurately perform the discharge amount control of the developer D in accordance with the deterioration state of the developer D of the previous history.

When the developing container 81 is provided with a path for increasing the discharge amount of the developer D in accordance with an increase in the charge amount of the toner D_t included in the developer D accommodated in the developing container 81, as the charge amount of the toner D_t included in the developer D increases, the discharge amount of the developer D is decreased. Therefore, it is also possible to cope with an increase in charge amount due to recovery of the charge amount during printing. As the charge amount of the toner D_t included in the developer D approaches the recovery state, the discharge amount of the developer D is increased, so that the discharge amount of the developer D can be smoothly approached a fixed amount as time elapses.

As the charge amount of the toner D_t included in the developer D approaches the recovery state or the stable state, the discharge amount of the developer D is increased. Therefore, it is also possible to cope with an increase in charge amount due to environmental change or the like. As the charge amount of the toner D_t included in the developer D approaches the stable state, the discharge amount of the developer D is increased, so that the discharge amount of the developer D can be smoothly approached to a fixed amount as time elapses.

Third Embodiment

Figure 12:
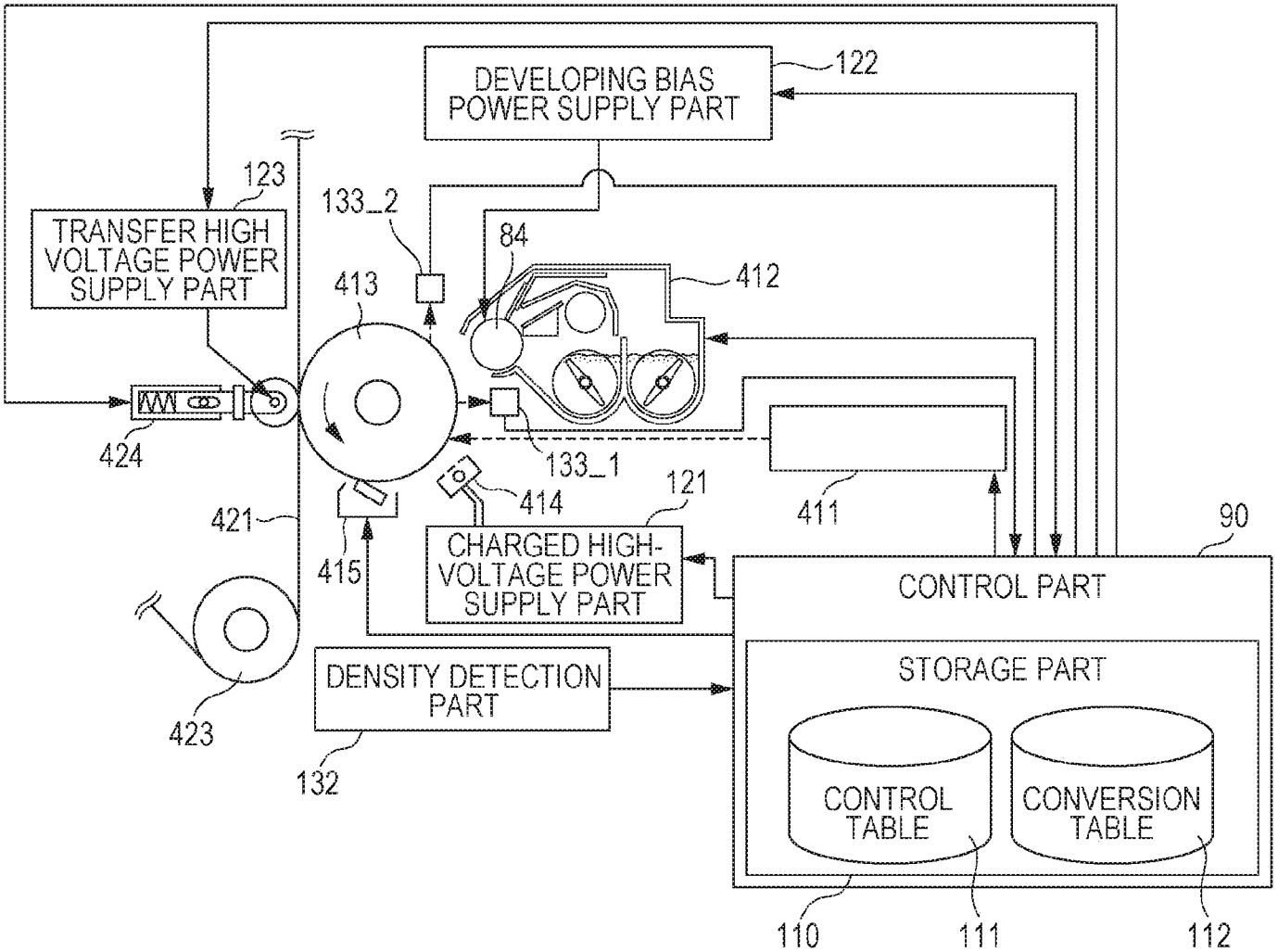
FIG. 12 is a diagram showing an example of the periphery and control functions of the developing device according to a third embodiment of the present disclosure.

In the third embodiment, the same components as those of the first and second embodiments are denoted by the same reference numerals, and description thereof is omitted. In the third embodiment, since the processing of controlling the discharge amount of the developer D by the manual control according to the first embodiment is performed in the similar manner, the description thereof will be omitted. The third embodiment is different from the first and second embodiments in that the total charge amount of the totter D_t included in the developer D is obtained by the surface potential of the photosensitive body 413. FIG. 12 is a diagram showing an example of a periphery and a control function of the developing device 412 according to the third embodiment of the present disclosure. A surface potential detection part 133_1 and a surface potential detection part 133_2 are provided on the photosensitive body 413. The surface potential detection part 133_1 and the surface potential detection part 133_2 detect the surface potential of the toner D_t included in the developer D transferred from the photosensitive body 413 to the intermediate transfer belt 421. Specifically, the surface potential detection part 133_1 is provided between the irradiation position of the laser beam by the exposure device 411 and the developing roller 84, and detects a first surface potential before the development of the patch image formed on the photosensitive body 413. The surface potential detection part 133_2 is provided in downstream of the developing roller 84 in the rotation direction of the photosensitive body 413, and detects a second surface potential after the development of the patch image formed on the photosensitive body 413. That is, a sensor for detecting the surface potential of the toner D_t is provided on both the upstream side and the downstream side of the development. Since the potential difference of the surface potential before and after development of the patch image is the toner layer potential, the total charge amount of the toner D_t can be obtained on the basis of the electrostatic capacity of the toner D_t.

Figure 13:
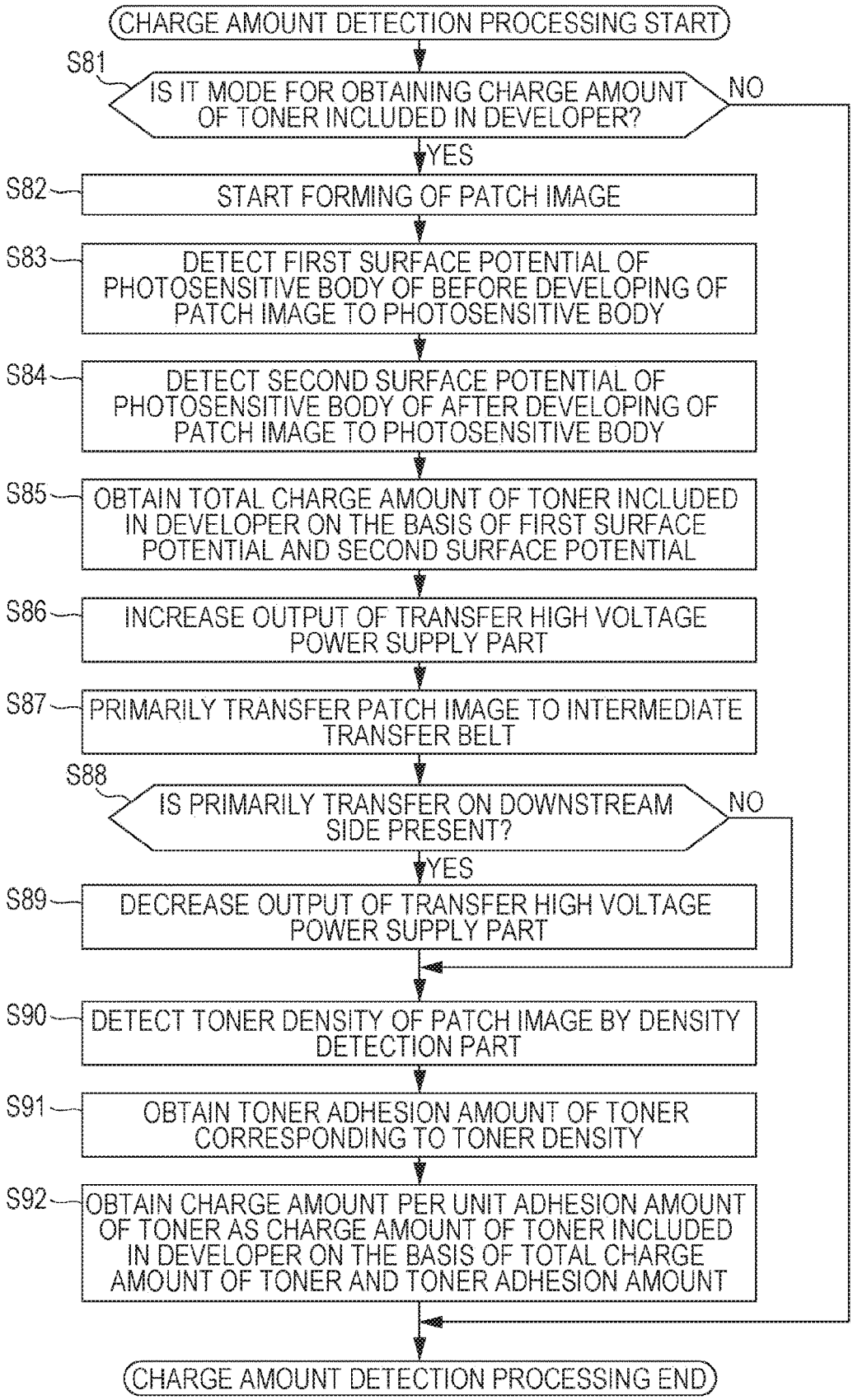
FIG. 13 is a flowchart illustrating an example of charge amount detection processing according to the third embodiment of the present disclosure.

FIG. 13 is a flowchart illustrating an example of charge amount detection processing according to the third embodiment of the present disclosure. Since the processing in step S81, step S82, steps S86 to S92 is similar to the processing in step S11, step S12, steps S16 to S22, description thereof will be omitted. In step S83, the image forming device 1 detects the first surface potential of the photosensitive body 413 before the patch image is developed on the photosensitive body 413. In step S84, the image forming device 1 detects the second surface potential of the photosensitive body 413 after the patch image is developed on the photosensitive body 413. In step S85, the image forming device 1 obtains the total charge amount of the totter D_t included in the developer D on the basis of the first surface potential and the second surface potential.

From the above description, according to the present embodiment, the total charge amount of the toner D_t included in the developer D is obtained on the basis of the surface potential. Therefore, since the total charge amount of the toner D_t included in the developer D can be obtained also by the detection of the surface potential, a configuration for obtaining the total charge amount of the toner D_t included in the developer D is realized in accordance with the situation as appropriate.

Although the developing device 412 and the image forming device 1 according to the present disclosure have been described above on the basis of the embodiments, the present disclosure is not limited thereto, and modifications may be made without departing from the spirit of the present disclosure.

For example, in the present embodiment, an example in which the storage part 110 is configured inside the control part 90 has been described. However, the present invention is not particularly limited thereto. For example, the storage part 110 may be configured outside the control part 90. In addition, in the present embodiment, an example has been described, in which the carrier D_c is also supplied with supply of the toner D_t, the excessive developer D is discharged, and the carrier D_c in the developing device 412 is gradually replaced, so that the charge amount of the toner D_t is stabilized. However, the present invention is not particularly limited thereto. Since any stabilization method may be employed as long as the method is the trickle developing method, for example, the carrier D_c and the toner D_t may be supplied separately.

Although embodiments of the present invention have been described and illustrated in detail, the disclosed embodiments are made for purposes of illustration and example only and not limitation. The scope of the present invention should be interpreted by terms of the appended claims.

What is claimed is:

1. A developing device for forming an image by developing an electrostatic latent image formed on an image carrier with a developer, the developing device comprising:

a developing container that accommodates the developer;

a developing roller that faces the image carrier, is disposed adjacent to the developing container, and conveys the developer accommodated in the developing container to the image carrier; and a developer discharging part that is provided in the developing container and discharges a part of the developer, wherein a discharge amount of the developer discharged by the developer discharging part is controlled on the basis of a fluctuation tendency of a charge amount of a toner included in the developer.

2. The developing device according to claim 1, further comprising a developing current detection part that detects a developing current flowing between the image carrier and the developing roller, wherein a total charge amount of the toner included in the developer is obtained in accordance with the developing current.

3. The developing device according to claim 1 further comprising a surface potential detection part that detects a surface potential of the toner included in the developer transferred from the image carrier to a transfer belt, wherein a total charge amount of the toner included in the developer is obtained on the basis of the surface potential.

4. The developing device according to claim 2 further comprising a density detection part that detects a toner density of the toner included in the developer that is transferred from the image carrier to a transfer belt and adheres thereto, wherein a charge amount of the toner included in the developer is obtained on the basis of the total charge amount of the toner included in the developer and a toner adhesion amount of the toner corresponding to the toner density detected by the density detection part.

5. A developing device for forming an image by developing an electrostatic latent image formed on an image carrier with a developer, the developing device comprising:

a developing container that accommodates the developer;

a developing roller that faces the image carrier, is disposed adjacent to the developing container, and conveys the developer accommodated in the developing container to the image carrier; and a developer discharging part that is provided in the developing container and discharges a part of the developer, wherein a discharge amount of the developer discharged by the developer discharging part is controlled on the basis of a charge amount of a toner included in the developer, wherein when the discharge amount of the developer is reduced in accordance with a decrease in the charge amount of the toner included in the developer accommodated in the developing container, as the charge amount of the toner included in the developer decreases, the discharge amount of the developer is increased.

6. A developing device for forming an image by developing an electrostatic latent image formed on an image carrier with a developer, the developing device comprising:

a developing container that accommodates the developer;

a developing roller that faces the image carrier, is disposed adjacent to the developing container, and conveys the developer accommodated in the developing container to the image carrier; and a developer discharging part that is provided in the developing container and discharges a part of the developer, wherein a discharge amount of the developer discharged by the developer discharging part is controlled on the basis of a charge amount of a toner included in the developer, wherein when the discharge amount of the developer is increased in accordance with a decrease in the charge amount of the toner included in the developer accommodated in the developing container, as the charge amount of the toner included in the developer decreases, the discharge amount of the developer is decreased.

7. A developing device for forming an image by developing an electrostatic latent image formed on an image carrier with a developer, the developing device comprising:

a developing container that accommodates the developer;

a developing roller that faces the image carrier, is disposed adjacent to the developing container, and conveys the developer accommodated in the developing container to the image carrier; and a developer discharging part that is provided in the developing container and discharges a part of the developer, wherein a discharge amount of the developer discharged by the developer discharging part is controlled on the basis of a charge amount of a toner included in the developer, wherein when the discharge amount of the developer is reduced in accordance with an increase in the charge amount of the toner included in the developer accommodated in the developing container, as the charge amount of the toner included in the developer increases, the discharge amount of the developer is increased.

8. A developing device for forming an image by developing an electrostatic latent image formed on an image carrier with a developer, the developing device comprising:

a developing container that accommodates the developer;

a developing roller that faces the image carrier, is disposed adjacent to the developing container, and conveys the developer accommodated in the developing container to the image carrier; and a developer discharging part that is provided in the developing container and discharges a part of the developer, wherein a discharge amount of the developer discharged by the developer discharging part is controlled on the basis of a charge amount of a toner included in the developer, wherein when the discharge amount of the developer is increased in accordance with an increase in the charge amount of the toner included in the developer accommodated in the developing container, as the charge amount of the toner included in the developer increases, the discharge amount of the developer is decreased.

9. The developing device according to claim 5, wherein as a state of the charge amount of the toner included in the developer approaches a recovered state or stable state, the discharge amount of the developer is decreased.

10. The developing device according to claim 6, wherein as a state of the charge amount of the toner included in the developer approaches a recovered state or stable state, the discharge amount of the developer is increased.

11. The developing device according to claim 1, wherein after a certain period of time has elapsed since operation of conveying the developer to the image carrier by the developing roller is stopped, the charge amount of the toner included in the developer is obtained.

12. The developing device according to claim 1, wherein when a surrounding environment satisfies a preset condition, the charge amount of the toner included in the developer is obtained.

13. A image forming device comprising the developing device according to claim 1.

14. The developing device according to claim 3, wherein the surface potential detection part includes two surface potential detectors, and the developing roller is arranged between the two surface potential detectors.

15. The developing device according to claim 5, wherein the discharge amount of the developer discharged by the developer discharging part is controlled on the basis of a fluctuation tendency of the charge amount of a toner included in the developer.

16. The developing device according to claim 6, wherein the discharge amount of the developer discharged by the developer discharging part is controlled on the basis of a fluctuation tendency of the charge amount of a toner included in the developer.

17. The developing device according to claim 7, wherein the discharge amount of the developer discharged by the developer discharging part is controlled on the basis of a fluctuation tendency of the charge amount of a toner included in the developer.

18. The developing device according to claim 8, wherein the discharge amount of the developer discharged by the developer discharging part is controlled on the basis of a fluctuation tendency of the charge amount of a toner included in the developer.

* * * * *